United States Patent [19]

Goff et al.

[11] 4,146,291

[45] Mar. 27, 1979

[54] ANTISTATIC ELECTRICAL CONNECTOR HOUSING

[75] Inventors: David A. Goff, Newport Beach; Larry S. Edman, Anaheim, both of Calif.

[73] Assignee: MSI Data Corporation, Costa Mesa, Calif.

[21] Appl. No.: 821,399

[22] Filed: Aug. 3, 1977

[51] Int. Cl.[2] ..... H01R 13/52

[52] U.S. Cl. ..... 339/111; 174/5 R; 339/211; 339/DIG. 3; 361/212

[58] Field of Search ..... 339/17 CF, 58, 59, 60, 339/62, 63, 111, 143, DIG. 3, 14, 211; 361/212, 215, 220; 174/5

[56] References Cited

U.S. PATENT DOCUMENTS

| | | | |
|---|---|---|---|
| 2,745,938 | 5/1956 | Brandler | 339/58 |
| 3,344,391 | 9/1967 | Ruete | 339/DIG. 3 |
| 4,040,120 | 8/1977 | Geadah et al. | 361/220 |

FOREIGN PATENT DOCUMENTS

| | | | |
|---|---|---|---|
| 941009 | 1/1974 | Canada | 361/212 |
| 2019639 | 11/1971 | Fed. Rep. of Germany | 339/14 R |

OTHER PUBLICATIONS

IBM Tech. Discl. Bulletin, Traviesco, vol. 19, No. 7, p. 2413, Dec. 1976.

MSI Data Corporation, Source 1100 Portable Data Terminal Operator's Guide, pp. 1, 2, 4, 6, 7, 8.

*Primary Examiner*—Neil Abrams

*Attorney, Agent, or Firm*—Edward J. DaRin

[57] ABSTRACT

A method and apparatus for protecting sensitive electronic components housed within a portable electronic component against damage due to the discharge of accumulated static charges. The electrical connector components are electrically isolated and housed within an insulative receptacle having very low conducting properties within the portable electronic component. The coacting electrical connector components are housed in a similar insulative conductive housing. The insulative housings are dimensioned to require physical contact between the two for a preselected time interval effective to discharge any static charge.

13 Claims, 6 Drawing Figures

ANTISTATIC ELECTRICAL CONNECTOR HOUSING

SUMMARY OF THE INVENTION

This invention relates to an insulative housing for an electrical connector utilized with portable electronic units and more particularly to insulative housings having preselected low electrical conductive properties for protecting the electronic units from damage due to the discharge of static charges.

At the present time, there are in use portable, battery operated electronic components that are carried by an individual from location to location during the course of utilizing the unit. One such electronic unit is known in the art as a data collection terminal. Data collection terminals have been developed for use in collecting inventory data in grocery stores, hardware stores, drug stores and similar retail outlets. In such inventory control applications, the data collection terminal is held in the operator's hand as he walks through the establishment for collecting data on the inventory or merchandise. The portable characteristic of a data collection terminal results in it not having any electrical conductive link to an external voltage reference or ground potential while the associated units utilized therewith are generally provided with a reference or ground potential. Accordingly, the electrical contacts of such a self-contained data collection terminal are electrically isolated from any conductive path external to the portable electronic unit.

Generally, a data collection terminal or similar hand-held electronic unit includes electronic components that are responsive to electromagnetic fields generated by the discharge of static electrical charges through the production of an arc in the dielectric medium, air, causing currents to be induced into the unit's components, such as the electronic memory or the like. In a data collection operation, the user or operator walks about an establishment with the data collection terminal in his hand as he gathers data. Because of the walking motion, sufficient rubbing action between the operator's feet and the floor is produced so as to cause a static charge to be generated. The static charge having no conductive link to a ground potential or reference potential is stored on the operator and the hand-held unit. If the static charge is still present when the portable electronic unit is to be connected to an external electronic unit, the breakdown of the dielectric at the interface or the air between the external component's connector and the electronic unit allows the accumulated static charge to discharge producing an arc. This static discharge produces an electromagnetic field that can, in turn, induce an electrical current into a circuit component of the data collection terminal. It is not uncommon to produce sufficient current under these conditions to cause hard and soft failures in the data collection terminal. These failures are evidenced by false data input, memory loss or component damage in the portable terminal.

PRIOR ART STATEMENT

An exhaustive prior art study was made prior to attempting to solve the particular static discharge problem disclosed above particularly with regard to hand-held portable data collection terminals. Information is available in the prior art and solutions pertaining to various aspects of the problem were located, however, no prior art was uncovered that dealt with protecting the sensitive components of the electronic unit after installation for portable applications. One such prior art solution to the static discharge problem was utilized in a data collection terminal identified as the MSI 1100 Data Collection Terminal available from MSI Data Corporation of Costa Mesa, Calif. It was found, however, that the solution incorporated in the MSI 1100 terminal was not adequate, it was extremely unattractive and required the operator to inflict discomfort upon himself, i.e., the operator would receive an electrical shock. The user could easily avoid obtaining a shock by rendering the mechanism ineffective. It was also determined that the mechanism was not always effective even when properly employed.

The present invention provides an improved, inexpensive, harmless and relatively foolproof method and apparatus for preventing damage to electronic components housed within the portable data collection units due to the discharge of static electrical charges produced upon interconnection of the portable unit with an external electronic unit. The electrical connector housed within the portable electronic unit is adapted to be coupled to an external unit and is arranged and spaced in an insulative housing that is slightly electrically conductive to present a low impedance interface to the mating connector contacts so as to cause a gradual lowering of any potential difference existing between the mating connector elements to thereby decrease it to a harmless level. The insulative, slightly conductive housing for the electrical contacts is separate from the insulative housing for the data collection terminal proper and is arranged in accordance with the present invention so as to be electrically isolated from any conductive path external to the portable, hand-held terminal. The corresponding mating connector for an external unit to be coupled to the portable data collection terminal is also provided with a similar insulative, slightly conductive housing for achieving the desired results.

From a method standpoint, the present invention comprehends a method of protecting a portable electronic unit from damage due to electrical discharges produced by static electrical potentials accumulated by an individual carrying the electronic unit upon the electrical interconnection of the electronic unit with an external electronic unit including the steps of arranging an electrical contact within the portable electronic unit so as to be electrically isolated from any electrical conductive path external to the portable electronic unit. An individual housing for the electrical contact of the electronic unit is provided that is constructed and defined of an insulative material having very low, electrical conductive properties and arranged in a preselected accessible location within the portable electronic unit and electrically connected to a point of reference potential for the electrical components housed within the portable electronic unit. This method includes housing an external, mating, electrical contact to be selectively placed into electrical contact with the thus housed contacts for the portable electronic unit with an insulative material having the same conductive properties as the first-mentioned material. The external electrical contact is connected to a point of electrical reference potential. The method further comprehends that while interconnecting the external electrical contact to the portable electronic unit causing any accumulated, static electrical charge existing in the portable electronic unit to be harmlessly transferred to the housing for the external contact by physical contact between the two for a sufficient time to render the charge harmless immediately prior to effecting any electrical interconnection of the contacts and any static discharge between the two contacts.

From a structural organization standpoint, the present invention provides a portable electronic unit adapted to be electrically interconnected with an external electronic unit comprising a portable, hand-held, electronic unit having means for interconnecting with an external electronic unit. The interconnecting means includes an electrical contact element housed in an insulative material having preselected electrical conducting potentials. The portable electronic unit is arranged to be electrically isolated from any electrical conductive path external thereto. The external electrical contact adapted to be interconnected with the electrical contact for the electronic unit is provided with an insulative housing constructed and defined of an insulative material having the same preselected electrical conducting properties as the insulative material employed for the contact of the portable electronic unit. The external electrical contact is connected to a point of reference potential. The electrical contact for the portable electronic unit is further arranged and located on the unit in a preselected spaced relationship so as to cause and require physical contact between the two insulative conductive housing materials for the coacting electrical contacts for a preselected time interval prior to completing the electrical connection to thereby cause any static electrical charge that may be present on the portable electronic unit to be harmlessly transferred to the point of electrical reference potential by means of the conductive insulative materials and the external electrical contact.

These and other features of the present invention may be more fully appreciated when considered in the light of the following specification and drawings, in which.

Figure 1:
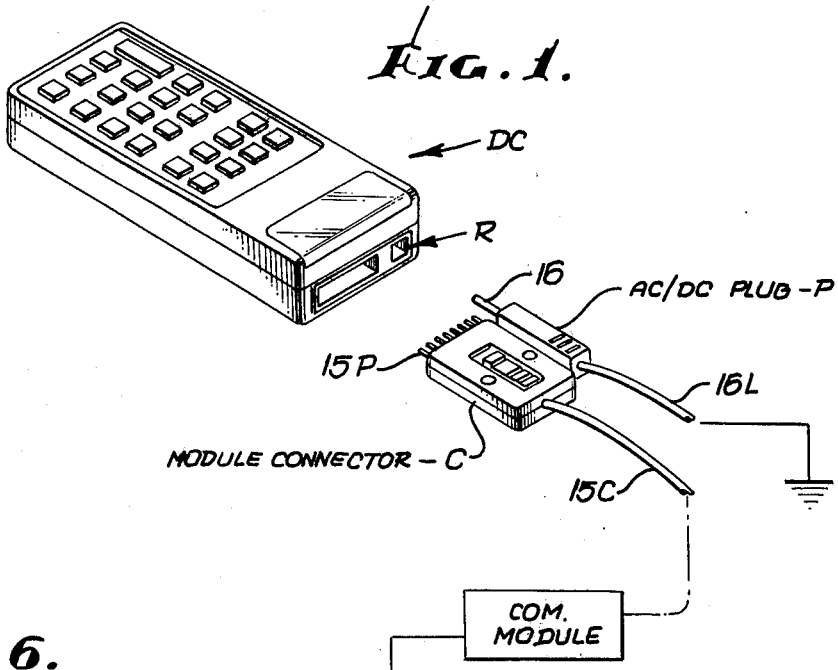
FIG. 1 is a perspective view of a self-contained portable electronic unit adapted to be interconnected with an external electronic unit diagrammatically illustrated, and illustrating a pair of electrical connectors in spaced alignment with the connector receptacles for the portable electronic unit and embodying the invention.

Now referring to the drawings, the present invention will be described in detail. In FIG. 1 there is represented an electronic component of an electronic data collection system in the form of a completely self-contained, portable data collection component DC. In accordance with the present invention, the data collection unit DC is provided with a separate housing or receptacle R for receiving a module connector C for interconnecting with an external unit of the data collection system. The external component of the system may be a communication module diagrammatically represented in block form as the COM module of the data collection system. The communication module or external component is generally provided with a point of reference potential or an electrical ground. The receptacle R of the data collection unit R is also adapted for receiving an AC/DC plug P. The plug P is also conventionally connected to a point of ground potential as diagrammatically illustrated. The receptacle R is constructed and defined of an insulative material having preselected low electrical conductive properties, particularly adapted for discharging an accumulated static charge as will be disclosed more fully hereinafter. The housing for the module connector C and the plug P are constructed and defined of the same insulative material having the same electrical properties as is utilized for the receptacle R.

Figure 6:
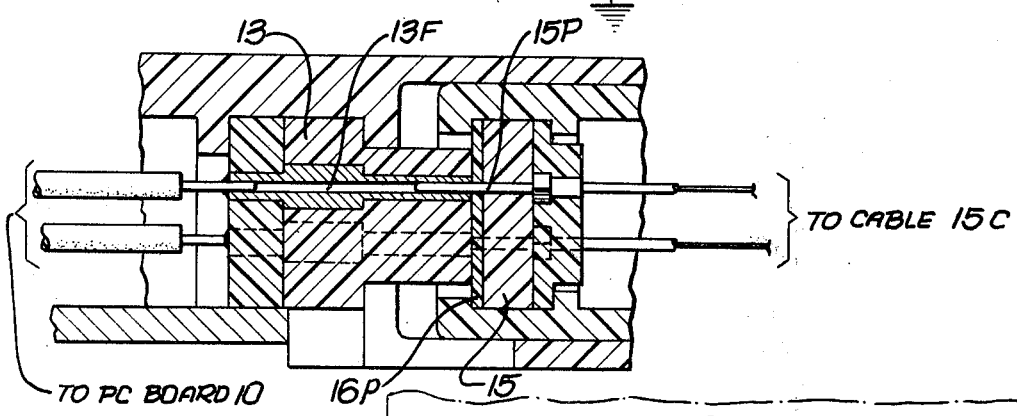
FIG. 6 is a cross-sectional view taken along the line 6—6 of FIG. 4.
Figure 2:
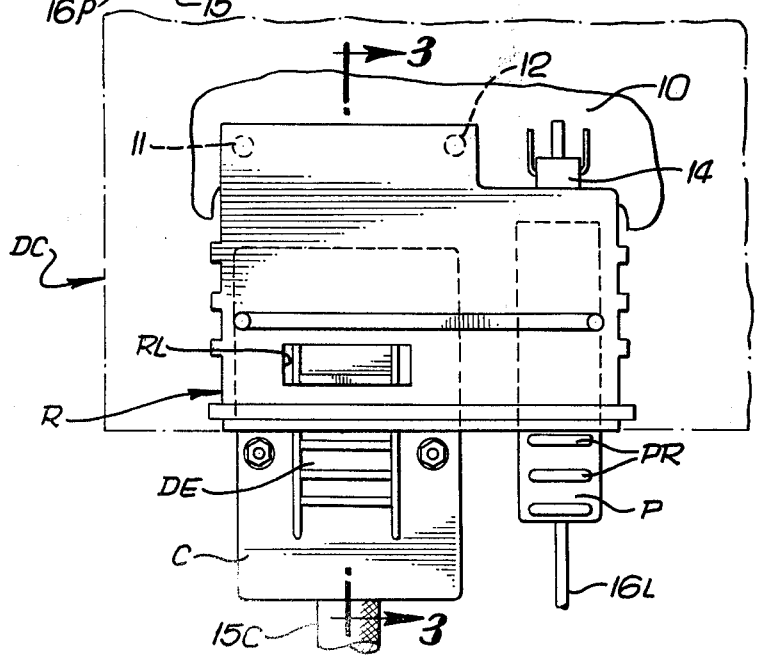
FIG. 2 is a top plan view of the connector receptacle as arranged in the portable unit of FIG. 1, illustrated in dotted outline and with the external connectors arranged therein.
Figure 4:
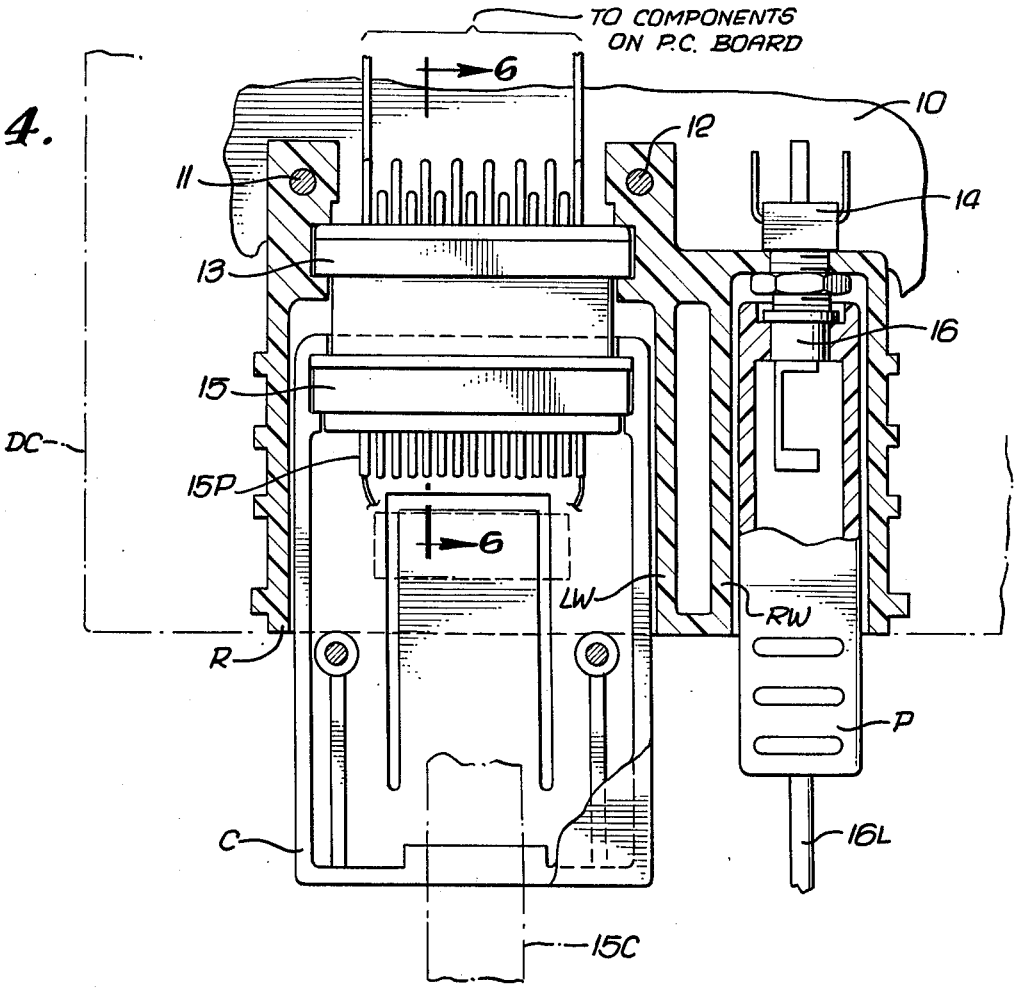
FIG. 4 is a cross-sectional view taken along the line 4—4 of FIG. 3 and illustrating the portable electronic unit housing in dotted outline.
Figure 3:
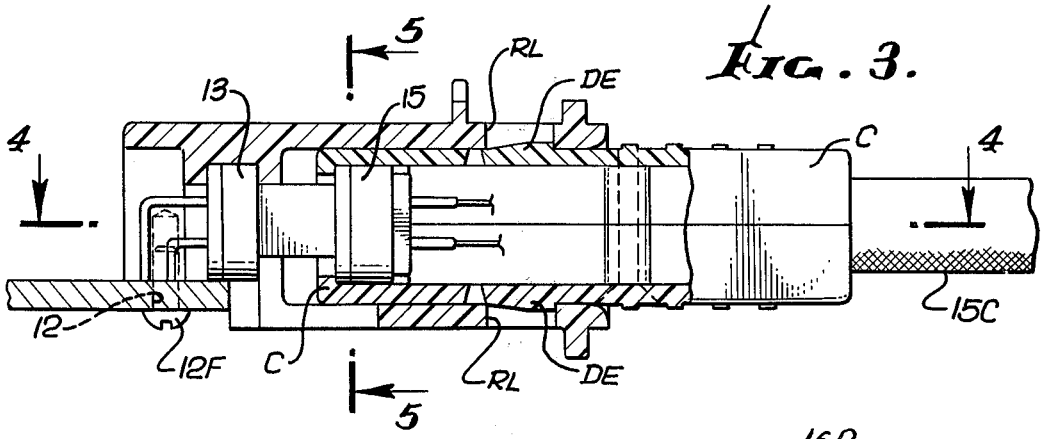
FIG. 3 is a cross-sectional view taken along the line 3—3 of FIG. 2.

Referring to FIGS. 2 and 4 in particular, the specific construction of the receptacle R as it is integrated into the data collection component DC will be described. The receptacle R is secured to a printed circuit board 10 mounted in the data collection component DC. The printed circuit board 10 as illustrated in FIG. 4 has a number of electrical components (not shown) mounted to the top side thereof and interconnected with the remaining components comprising the data collection component DC. The receptacle R is physically and electrically connected with a printed circuit board 10 by means of fasteners, such as the fastener 12F, secured to the apertures 11 and 12 which are provided on the back side of the receptacle R, as best appreciated from examining FIGS. 3 and 4. The fasteners secured in the apertures 11 and 12 function as a ground plane for the components mounted on the printed circuit board 10 and are directly secured to the insulative material for the receptacle R. The receptacle R is mounted within one end of the data collection component DC. The receptacle R functions as a housing for a pair of female electrical connectors for separately receiving the module connector C and the AC/DC plug P. One of the female connectors, as illustrated in FIG. 4 comprises a commercially available standard 15-pin series D subminiature female connector available from Cannon Electric Company as Part No. 195-0601-000 and is identified in FIG. 4 as the element 13. The connector element 13 has 90 degree flow solder contacts for mounting to the printed circuit board 10. The element 13 as utilized in the present invention is slightly modified from its commercial structure by removing the housing that is normally provided for the two-piece nylon body of the connector. The housing that is normally provided with the connector 13 is a metallic shell so that with its removal the standard female pin connectors 13F are mounted in a plastic material that is completely an electrical insulator. As assembled within the receptacle, the pin connectors 13F for the element 13 are electrically isolated from any conductive path external to the component DC. One end of each of the female pins 13F of element 13 is secured by lead wires connected thereto to the components arranged on the printed circuit board 10. The opposite ends of the connector pins 13F of the element 13 have a female receptacle for receiving corresponding male connector pins therein; see FIG. 6.

The receptacle R also houses a standard commercially available female jack connector for receiving the corresponding male contact for the plug P. The jack connector as illustrated in FIG. 4 is identified by the reference number 14 and may comprise a standard commercially available jack available from Switchcraft Company, Model TR-2A. The female jack 14 is adapted for electrical connection with a Switchcraft male plug, Model 850, housed within the AC/DC plug P. The jack 14 is mounted to the interior end of the receptacle R with the jack unit extending outwardly thereof. The receptacle R is constructed and defined for providing a separate receptacle for receiving the plug P and which receptacle is defined by the longitudinally extending wall RW for slidably receiving the plug housing P and placing it in electrical contact with the jack 14. A similar longitudinally extending wall LW defines the individual receptacle for the connector C; see FIG. 4.

At this point, it should be noted that both the female connector 13 and the jack 14 are arranged a preselected distance inwardly of the open end of the receptacle R or the end slidably receiving the connector C and/or the plug P. The distance that the contacts 13 and 14 are mounted inwardly of the open end of the receptacle R has been selected to cause sliding contact between the housing for the connector C and/or the housing for the connector P and the receptacle for providing sufficient time to discharge to a harmless level any static charge that may have been accumulated on the component DC. It has been found that at least ⅜" of contact is required between the housings for the connector components prior to the time the male/female connection is made. With the insulative materials utilized in accordance with the present invention, this distance translates to a discharge time on the order of 0.1 seconds.

Figure 5:
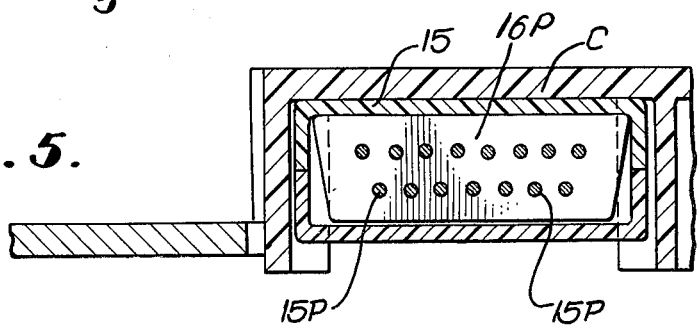
FIG. 5 is a cross-sectional view taken along the line 5—5 of FIG. 3.

Now referring to the construction of the housing for the module connector C, as particularly illustrated in FIGS. 2 and 5, the construction of the connector will be described in detail. The connector C comprises a mating commercially available Cannon connector for coacting with the female connector 13. The male connector may be the Cannon connector Part No. 143-1805-000 with the two-piece nylon body and 26 AWG pins, Cannon Part No. 030-1952-002. The male connector 15, mounted within the housing for the connector C, is modified in the same fashion as the female unit 13 by removing the metallic shell from the nylon body. Accordingly, the male connection pins 15P are mounted in an insulative spaced-apart relationship as commercially available within the housing for the connector C. To assure that the static charge is properly conveyed through the connector housing C, a wiper plate 16P is mounted in intimate relationship with the outer face of the connector 15 and in intimate electrical contact with each of the pins 15P; see FIG. 5. The wiper plate 16P is a thin conductive plate having a plurality of apertures corresponding to the number of male pins 15P for securing the pins in the apertures and in electrical conducting relationship therewith. The portion of pins 15P protruding outwardly from the face of the wiper plate 16P is aligned with the corresponding receptacles of the female element 13 for insertion therein when the connector C is properly mounted in electrical connecting arrangement with the data collection unit DC. The arrangement of an interconnected pin 15P with the female pin 13F is specifically illustrated in FIG. 6. The inner ends of the pins 15P are connected to individual lead wires arranged in a cable 15C and which cable is connected to the external electronic component or the communication module; see FIG. 1.

The connector C is constructed of an insulative material having the same electrical conductive properties as the receptacle R. The housing for the connector C is constructed and defined so that it is slidably received into the receptacle R so as to travel the necessary distance for placing the pins 15P into electrical engagement with the corresponding female receptacles defined in the pins 13F for the connector 13. The top and bottom surfaces of the connector C are each defined with an integral detenting element DE which is defined to be movable inwardly into the plane of the connector C for engagement with corresponding locking apertures RL provided in top and bottom surfaces of the receptacle R. In this fashion, the connector C may be securely positioned within the data collection component DC in electrical engagement with the receptacle 13.

The AC/DC plug D is similarly constructed to be slidably received in its individual compartment within the receptacle R. The male connecting portion 16 of the plug P may be a commercially available Switchcraft Model 850 plug that mounts into the jack 14 and is housed in an insulative material having the same electrical conductive properties as the receptacle R and the module connector C. The male connecting element 16 for the plug P is connected to a lead wire 16L which in turn is coupled to ground potential. The housing for the plug P is essentially of a square configuration and has a plurality of upstanding ridges for properly locating the plug P within the receptacle R. The ridges are identified in FIG. 2 by the letters PR. When mounted within the receptacle R, the ridges PR of the plug P move into engagement with the coacting face on the receptacle R. The insulative material having the desired electrical properties utilized for the housing R, C and P have low electrical conductive properties selected to cause a discharge of accumulated static over a preselected period of time.

The conductive properties for the insulative material for the housings R, C and P have been selected for providing a normal discharge time on the order of 0.1 seconds. For this purpose, it has been found advantageous to incorporate into the insulative material conductive material so as to provide a volume resistance on the order of 50,000,000 ($5 \times 10^7$) ohm - centimeter. In order to provide an insulative material having these conductive properties that can be readily produced and tested an injection molding synthetic resin material has been developed since no material having the required insulative and electrical properties was commercially available.

The material presently preferred and in use is a blend of Three M Company Velostat, No. 4520, an electrically conductive injection molding resin unmodified polypropylene homopolymer. The conductivity of the Velostat material varies from batch to batch so that no set ratio of ingredients has been established. The amount of conducting carbon black present in the Velostat material is not publicly available. Material of the appropriate volume resistivity ($\approx 5 \times 10^7\ \Omega - CM$) has been molded from a 35% Velostat and 65% polypropylene blend, the percentages being by weight. The Velostat material is compounded with the polypropylene homopolymer to produce the desired electrical conductive properties.

The Velostat No. 4520 material is a highly conductive black injection molding resin. The conductivity and color are presumably the result of the addition of carbon black to a natural resin. Because Velostat material was found to be compatible with polypropylene homopolymer this blend was selected to provide the desired properties for the antistatic connector housing disclosed herein. In effect, carbon black could be added to any number of injection molding resins to produce the desired electrical properties. This was, in fact, done initially. However, the time and inconvenience involved made this method unacceptable for testing the concept.

With the above structure in mind, the arrangement for interconnecting the module connector C and/or the AC/DC plug P to provide the desired discharge of any accumulated static electrical charge can now be appreciated. It should be appreciated that as the user of the component DC walks around with the terminal DC in hand, a static charge accumulates on the user and migrates to the component DC. When the user touches an electrical conductor the charge that he has accumulated on himself is discharged. If the conductor is the electrical connector for the component DC, the charge is discharged when an external electrical connector is connected to the component DC. As described hereinabove, the female connector contacts 13 and 14 in accordance with the present invention are electrically isolated from any conductive path external to the component DC and are housed within the insulative, conductive receptacle R.

The dimensions for the receptacle R and the location of the female contacts 13 and 14 have been selected to prevent any electrical interconnection to these elements without first producing physical contact between the receptacle R and the housings for the elements C and/or P. Sliding contact is maintained between the receptacle R and the housings for the connector C or on the housing for the plug P for at least ⅜" before electrical connection is made with either the receptacle 13 or the jack 14. The time normally required to move the connector C or the plug P the necessary ⅜" is on the order of 0.1 second which is sufficient time necessary to cause the potential difference between the two housings to be equalized enough to prevent any arcing between the coacting electrical connector components. This slow discharge time has also been found to be sufficient to minimize any current surge through the data collection component DC that might induce currents in any sensitive electrical components housed therein. Specifically considering the discharging action relative to the connector C, it should be noted that any static electrical charge accumulated on the terminal DC is coupled to ground or a point of reference potential by means of the conductive insulative material comprising the receptacle R and the connector housing C by means of the wiper plate 16, the connector pins 15P and the electrical cable 15C which is electrically connected to the pins 15P, which cable in turn is connected to ground through the external component as viewed in FIG. 1. The plug P is similarly arranged to provide the coupling by means of the female jack 14 coacting with the male contact 16 through its individual cable 16L to ground.

What is claimed is:

1. A portable, electronic unit adapted to be electrically interconnected with an external electronic unit comprising a portable, hand-held electronic unit having means for interconnecting with an external electronic element, said means including an electrical contact element housed in an insulative material having preselected electrical conducting properties, the electronic unit being electrically isolated from any electrical conductive path external to the portable electronic unit and thereby accummulates any static electrical charge migrating from the operator to the unit by means of the insulative material, and an external electrical contact adapted to be interconnected with the electrical contact for the electronic unit, an insulative housing for the electrical contact constructed and defined of an insulative material having preselected electrical conducting properties the same as the first-mentioned insulative material, the external electrical contact being connected to an external point of electrical reference potential, the electrical contact for the electronic unit being arranged on the unit in a spaced relationship for causing physical contact between said insulative materials for said contacts for a preselected time interval prior to actual electrical interconnection to cause any static, electrical charge that may be present on the electronic unit to be harmlessly transferred to the external point of electrical reference potential by means of the conductive insulative materials and the external electrical contact when said electronic unit and electrical contact are positioned to be interconnected to effect the interconnection of the two without shock to the operator and/or any damage to the electronic unit due to the static discharge between the two said contacts.

2. A portable, electronic unit adapted to be electrically interconnected with an external electronic unit as defined in claim 1 wherein the conductive, insulative materials have a volume resistivity on the order of 50,000,000 ohm - centimeter.

3. A portable, electronic unit adapted to be electrically interconnected with an external electronic unit as defined in claim 2 wherein the material is an electrically conductive, plastic material.

4. A portable, electronic unit adapted to be electrically interconnected with an external electronic contact as defined in claim 1 wherein the electrical contact for the electronic unit is arranged inwardly of a side of the unit a preselected distance, the conductive insulative housing for said electrical contact being constructed and defined to cause physical electrical contact with the housing for the external electrical contact for a preselected time interval immediately prior to effecting an electrical interconnection between the two contacts.

5. A portable, electronic unit adapted to be electrically interconnected with an external electronic contact as defined in claim 4 wherein the preselected time interval is at least on the order of 0.1 seconds.

6. A portable, electronic unit adapted to be electrically interconnected with an external electronic contact as defined in claim 5 wherein the electronic unit is a battery powered data collection recording unit.

7. A portable, electronic unit adapted to be electrically interconnected with an external electronic unit as defined in claim 1 wherein the external electrical contact comprises a plurality of spaced apart male pins mounted in said insulative housing at the outer face thereof, and in intimate electrical relationship with the outer face of said insulative housing and in intimate electrical contact with each of said pins to thereby assure that any static charge is properly conveyed through said insulative housing and the pins to the point of reference potential, and the electrical contact element for the electronic unit comprises a female connector element adapted to be interconnected with each of said pins.

8. A method of protecting a portable, electronic unit from damage due to electrical discharges produced by static electrical potentials accumulated by an individual carrying the electronic unit and transferred to the electronic unit from the individual upon the electrical interconnection of the electronic unit with an external electronic unit and without shocking the individual, including the steps of arranging an electrical contact within the portable electronic unit so as to be electrically isolated from any electrical conductive path external to the portable electronic unit, providing an individual housing for the electrical contact constructed and defined of an insulative material having very low electrical conductive properties and arranged in a preselected, accessible location within the portable electronic unit and electrically connected to a point of reference potential for the electrical components housed within the portable electronic unit, housing an external, mating, electrical contact to be selectively placed in electrical contact with the thus housed electrical contact for the portable electronic unit in an insulative material having the same conductive properties as the first-mentioned insulative material, the latter-mentioned electrical contact being connected to an external point of electrical reference potential and while interconnecting the external electrical contact and the contact for the portable electronic unit causing any accumulated, static electrical charge existing in the portable electronic unit to be transferred to the housing for the external contact by physical contact with the housing for the electrical contact of the portable electronic unit immediately prior to effecting any electrical interconnection of the contacts and/or static discharge between the two contacts.

9. A method of protecting a portable, electronic unit from damage as defined in claim 8 wherein the step of interconnecting the electrical contacts includes moving the electrical contacts towards one another so as to travel a preselected distance prior to any interconnection of the two contacts for causing the discharge of any accumulated static electrical charge prior to reaching the point of interconnection.

10. A method of protecting a portable, electronic unit from damage as defined in claim 8 including the steps of spacing the electrical contact on the electronic unit a preselected distance inwardly of a side of the unit for causing the external mating element to travel a preselected distance in sliding engagement with the first-mentioned material for said electrical contact whereby any difference in electrical potential carried by the housings for the electrical contacts will be lowered to a potential level for preventing any harmful static discharge at the electronic unit between the electrical contacts, and interconnecting the external, mating electrical contact with the electronic unit contact by sliding the external contact into the electronic unit so as to travel the preselected distance to thereby discharge any accumulated static charge prior to approaching the point of interconnecting the contacts and then connecting the two contacts.

11. A method of protecting a portable, electronic unit from damage due to a static discharge including the steps of providing an electronic unit carrying an electrical connector element that is electrically isolated from any conductive path external to the electronic unit, the electrical connector being adapted for mating with another electrical connector, the electronic unit being capable of receiving a static electrical potential from the operator of the unit, providing an external electrical connector element adapted for mating with the connector element carried by said electronic unit for interconnecting said electronic unit with an external electronic unit, arranging each of said mating connector element in an insulative housing material having a preselected, low electrical conductivity, and interconnecting the thus housed electrical connector elements by initially causing physical contact between the electronic unit housing and the electrical connector housing prior to interengaging the electrical connector mating elements for causing any difference in electrical potential between the electronic unit and the connector element to be lowered to an electrical potential level for preventing harmful static discharge between the mating electrical connector elements immediately prior to the interconnection and upon interconnection.

12. A portable, electronic unit adapted to be electrically interconnected with an external electronic unit as defined in claim 2 wherein the external electrical contact comprises a plurality of spaced apart male pins mounted in said insulative housing at the outer face thereof, and in intimate electrical relationship with the outer face of said insulative housing and in intimate electrical contact with each of said pins to thereby assure that any static charge is properly conveyed through said insulative housing and the pins to the point of reference potential, and the electrical contact element for the electronic unit comprises a female connector element adapted to be interconnected with each of said pins.

13. A portable, electronic unit adapted to be electrically interconnected with an external electronic unit as defined in claim 16 wherein the material is an electrically conductive, plastic material.

* * * * *

UNITED STATES PATENT OFFICE

CERTIFICATE OF CORRECTION

Patent No. 4,146,291 Dated March 27, 1979

Inventor(s) David A. Goff and Larry S. Edman

It is certified that error appears in the above-identified patent and that said Letters Patent are hereby corrected as shown below:

Claim 13, column 10, line 54. The numeral "16" should read --12-- .

Signed and Sealed this

*Seventeenth* Day of *July 1979*

[SEAL]

*Attest:*

*Attesting Officer*

LUTRELLE F. PARKER

*Acting Commissioner of Patents and Trademarks*